US009666322B2

(12) United States Patent
Mazor et al.

(10) Patent No.: US 9,666,322 B2
(45) Date of Patent: May 30, 2017

(54) X-RAY SOURCE ASSEMBLY

(71) Applicant: JORDAN VALLEY SEMICONDUCTORS LTD., Migdal HaEmek (IL)

(72) Inventors: Isaac Mazor, Haifa (IL); Asher Peled, Kfar-Vradim (IL); Alex Brandt, Tiberias (IL); Matthew Wormington, Littleton, CO (US)

(73) Assignee: BRUKER JV ISRAEL LTD, Migdal Haemek (IL)

( * ) Notice: Subject to any disclaimer, the term of this patent is extended or adjusted under 35 U.S.C. 154(b) by 268 days.

(21) Appl. No.: 14/565,474

(22) Filed: Dec. 10, 2014

(65) Prior Publication Data

US 2015/0243469 A1 Aug. 27, 2015

Related U.S. Application Data

(60) Provisional application No. 61/943,419, filed on Feb. 23, 2014.

(51) Int. Cl.

| | |
|---|---|
| ***H01J 35/04*** | (2006.01) |
| ***G21K 1/06*** | (2006.01) |
| ***H01J 35/14*** | (2006.01) |
| ***H05G 1/52*** | (2006.01) |

(52) U.S. Cl.

CPC ..... *G21K 1/06* (2013.01); *H01J 35/14* (2013.01); *H05G 1/52* (2013.01)

(58) Field of Classification Search

CPC .. H01J 35/14; H01J 35/06; H01J 35/08; H01J 2235/087; H01J 35/30

See application file for complete search history.

(56) References Cited

U.S. PATENT DOCUMENTS

| | | | |
|---|---|---|---|
| 3,239,706 | A | 3/1966 | Farrell et al. |
| 3,668,454 | A | 6/1972 | Shimura et al. |
| 6,282,263 | B1 | 8/2001 | Arndt et al. |
| 6,935,778 | B2 | 8/2005 | Bievenue et al. |
| 6,947,522 | B2 | 9/2005 | Wilson et al. |
| 6,975,703 | B2 | 12/2005 | Wilson et al. |

(Continued)

FOREIGN PATENT DOCUMENTS

| | | | |
|---|---|---|---|
| EP | 2050100 | A2 | 4/2009 |

OTHER PUBLICATIONS

Rtw Röntgen-Technik Dr. Warrikhoff GmbH & Co., MCBM 50-0,6B x, Metal-Ceramic X-Ray Tube, Data sheet,1 pages, Aug. 6, 2009.

(Continued)

*Primary Examiner* — Hoon Song

(74) *Attorney, Agent, or Firm* — D.Kligler IP Services Ltd.

(57) ABSTRACT

An apparatus includes an X-ray tube, X-ray optics, one or more coils and control circuitry. The X-ray tube is configured to direct an electron beam onto an anode so as to emit an X-ray beam. The X-ray optics which configured to receive the X-ray beam emitted from the X-ray tube and to direct the X-ray beam onto a target. The coils are configured to steer the electron beam in the X-ray tube using electrical currents flowing through the coils. The control circuitry is configured to compensate for misalignment between the X-ray tube and the X-ray optics by analyzing the X-ray beam output by the X-ray optics, and setting the electrical currents based on the analyzed X-ray beam.

16 Claims, 2 Drawing Sheets

(56) References Cited

U.S. PATENT DOCUMENTS

| | | | | |
|---|---|---|---|---|
| 6,993,115 | B2 | 1/2006 | McGuire et al. | |
| 7,104,690 | B2 | 9/2006 | Radley et al. | |
| 7,257,193 | B2 | 8/2007 | Radley et al. | |
| 7,706,506 | B1 | 4/2010 | Woodruff et al. | |
| 7,983,394 | B2 | 7/2011 | Kozaczek et al. | |
| 8,472,586 | B2 | 6/2013 | Ueda et al. | |
| 8,515,012 | B2 | 8/2013 | Koppisetty et al. | |
| 2003/0021377 | A1 | 1/2003 | Turner et al. | |
| 2011/0058655 | A1 | 3/2011 | Okumura et al. | |
| 2012/0269326 | A1* | 10/2012 | Adler | H01J 35/08 378/138 |
| 2013/0235975 | A1 | 9/2013 | Tamura et al. | |
| 2014/0105367 | A1* | 4/2014 | Horvarth | H01J 35/14 378/138 |
| 2014/0369469 | A1 | 12/2014 | Ogura et al. | |

OTHER PUBLICATIONS

X-Ray Optical Systems, Inc, Doubly Curved Crystals—for Monochromatic Micro X-Ray fluorescence and X-Ray Diffraction, 2 pages, 2008.

AXO Dresden Gmbh,"ASTIX-c 2 dimensional parallel beam X-ray optics", Applied X-Ray Optics, 3 pages, May 2013.

U.S. Appl. No. 14/849,647 Office Action dated Feb. 6, 2017.

* cited by examiner

X-RAY SOURCE ASSEMBLY

CROSS-REFERENCE TO RELATED APPLICATIONS

This application claims the benefit of U.S. Provisional Patent Application 61/943,419, filed Feb. 23, 2014, whose disclosure is incorporated herein by reference.

FIELD OF THE INVENTION

The present invention relates generally to X-ray analysis, and particularly to X-ray source assemblies.

BACKGROUND OF THE INVENTION

X-ray techniques are used in a wide range of apparatus, such as metrology applications in semiconductor manufacturing processes. Examples of prior art techniques are provided below.

U.S. Pat. No. 6,282,263, to Arndt, et al., whose disclosure is incorporated herein by reference, describes an X-ray generator which produces an X-ray source having a focal spot or line of very small dimensions and which is capable of producing a high intensity X-ray beam at a relatively small point of application using a low operating power.

European Patent 2,050,100, to Boulee, et al., whose disclosure is incorporated herein by reference, describes a system for delivering an X-ray beam, comprising a source block that emits a source X-ray beam and conditioning means for conditioning the source beam sent towards a specimen. The system includes stabilization means designed to thermally stabilize a region of the system lying downstream of the source block, in order to limit heat transfer towards the conditioning means for the purpose of preventing thermal perturbations in the conditioning means.

U.S. Pat. No. 6,935,778, to Bievenue, et al., whose disclosure is incorporated herein by reference, describes methods and devices for aligning and determining the focusing characteristics of X-ray Optics. The methods and devices are stated to simplify the process of aligning an X-ray optic device to an X-ray source or for measuring a focusing characteristic, for example, the focal length or beam shape, of an X-ray optic.

U.S. Pat. No. 7,104,690, to Radley, et al., whose disclosure is incorporated herein by reference, describes a diagnostic technique for an X-ray source. A system monitors existing conditions (e.g., tube current) in the source to track degradation of certain components to anticipate failure. Storage of past characteristics and reference characteristics is also provided for predicting failure and other operating conditions of the source. Communication techniques are provided for the monitoring and warning functions.

U.S. Pat. No. 7,257,193, to Radley, et al., whose disclosure is incorporated herein by reference, describes an X-ray source assembly having enhanced output stability using tube power adjustments and remote calibration. A control system is provided for maintaining intensity of the output X-rays dynamically during operation of the X-ray source assembly, notwithstanding a change in at least one operating condition of the X-ray source assembly, by changing the power level supplied to the assembly. The control system may include at least one actuator for effecting the change in the power level supplied to the assembly, by, e.g., controlling a power supply associated with the assembly. The control system may also change the temperature and/or the position of the anode to maintain the output intensity.

U.S. Pat. No. 8,515,012, to Koppisetty, et al., whose disclosure is incorporated herein by reference, describes an X-ray tube with high speed beam steering electromagnets. The X-ray tube includes an electron beam source, a target configured to generate X-rays when impacted by an electron beam from the electron beam source, and a steering magnet assembly having a plurality of ferrite cores and a plurality of litz wire coils wound on the ferrite cores.

SUMMARY OF THE INVENTION

An embodiment of the present invention that are described herein provides an apparatus including an X-ray tube, X-ray optics, one or more coils and control circuitry. The X-ray tube is configured to direct an electron beam onto an anode so as to emit an X-ray beam. The X-ray optics which configured to receive the X-ray beam emitted from the X-ray tube and to direct the X-ray beam onto a target. The coils are configured to steer the electron beam in the X-ray tube using electrical currents flowing through the coils. The control circuitry is configured to compensate for misalignment between the X-ray tube and the X-ray optics by analyzing the X-ray beam output by the X-ray optics, and setting the electrical currents based on the analyzed X-ray beam.

In some embodiments, the control circuitry is configured to set the electrical currents to be constant. In alternative embodiments, the control circuitry is configured to set the electrical currents adaptively based on the analyzed X-ray beam. In a disclosed embodiment, the target includes a detector included in the control circuitry, and the control circuitry further includes a processor configured to analyze an output of the detector and to set the electrical currents depending on the output.

In some embodiments, the control circuitry is configured to estimate a deviation of an actual characteristic of the emitted X-ray beam from a specified characteristic, and to set the electrical currents depending on the deviation. The actual and specified characteristics may include at least one type of characteristic selected from a group of types consisting of a beam intensity, a beam spot size, and an intensity distribution across a beam spot.

In an embodiment, the control circuitry is configured to optimize a characteristic of the X-ray beam by setting the electrical currents in addition to compensating for the misalignment. In an example embodiment, the X-ray tube includes an integrated magnetic shield, which is configured to protect the electron beam from magnetic fields external to the X-ray tube.

There is additionally provided, in accordance with an embodiment of the present invention, a method including directing an electron beam in an X-ray tube onto an anode so as to emit an X-ray beam. The X-ray beam emitted from the X-ray tube is received and directed by X-ray optics onto a target. The electron beam is steered in the X-ray tube using electrical currents flowing through coils surrounding the X-ray tube. Misalignment between the X-ray tube and the X-ray optics is compensated for by analyzing the X-ray beam output from the X-ray optics and setting the electrical currents based on the analyzed X-ray beam.

The present invention will be more fully understood from the following detailed description of the embodiments thereof, taken together with the drawings in which:

DETAILED DESCRIPTION OF EMBODIMENTS

Overview

Figure 1:
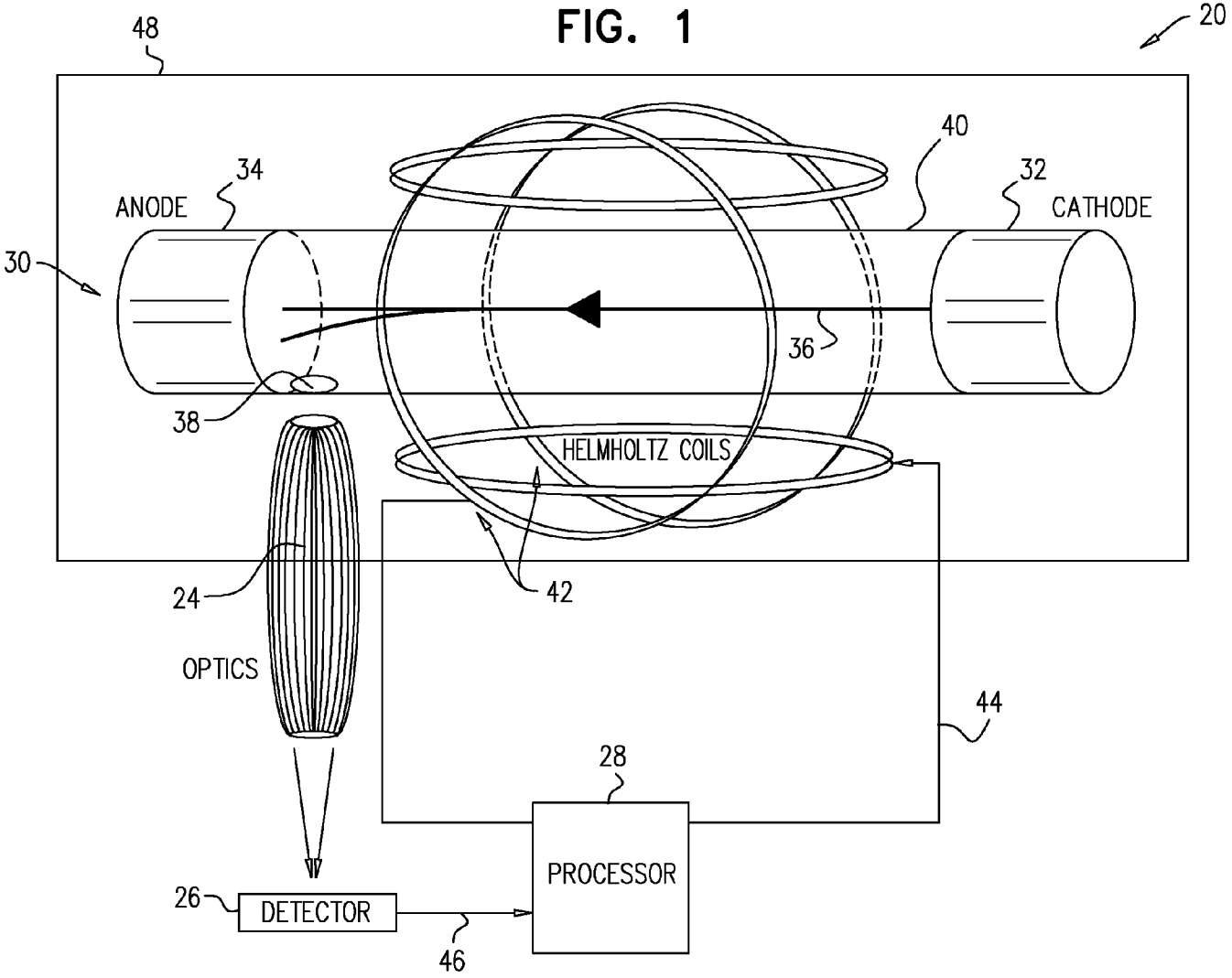
FIG. 1 is a block diagram that schematically illustrates an X-ray source assembly, in accordance with an embodiment of the present invention.

Compact, micro-focus X-ray sources are used in a variety of X-ray measurement systems, including X-ray characterization and metrology tools for the semiconductor manufacturing industry. A variety of analytical techniques, such as X-ray fluorescence (XRF), X-ray reflectivity (XRR) and X-ray diffraction (XRD) can benefit from an X-ray source that delivers a beam with characteristics that are optimized for the intended application. Typically, the source should be easy to install and setup, and should provide stable operation over long periods of time with minimal user intervention.

Embodiments of the present invention that are described hereinbelow provide improved X-ray source assemblies and associated methods. The assembly may typically be used in an X-ray characterization and metrology system.

In some embodiments the source assembly comprises an X-ray source and X-ray optics that are aligned relative to each other to generate desired characteristics of an X-ray beam produced by the assembly. The X-ray source comprises an X-ray tube surrounded by Helmholtz coils made of insulated solid wires, and X-rays produced by the source are transmitted via the X-ray optics so as to generate a desired X-ray beam. Different alignments between the X-ray source and the X-ray optics may be implemented to produce different beam intensity distributions, the distributions typically being a function, inter alia, of the energy/wavelength, the spatial distribution, and/or the convergence/divergence angle of the beam.

In an embodiment, coarse alignment between the X-ray source and the X-ray optics is affected by a mechanical adjustment between the two entities. The adjustment may be locked so that (nominally) there is no relative motion between the source and the optics.

In some embodiments, fine adjustment of the assembly is implemented by detecting the X-ray beam emitted from the optics, and analyzing the beam optical characteristics using X-ray beam detection and analysis circuitry. Based on the analysis, a processor comprised in the assembly adjusts Direct Current (DC) to one or more pairs of Helmholtz coils, surrounding the X-ray tube, so as to steer an electron beam produced in the X-ray source onto a selected region of the surface of the anode of the tube. In some embodiments there are two pairs of Helmholtz coils oriented orthogonally to each other. Steering the electron beam onto a selected region of the anode is used to improve the alignment between the tube and the optics.

In an embodiment, a ferromagnetic core is incorporated into a given pair of Helmholtz coils to enhance the magnetic field produced by the coils.

The alignment DC current of the coils may be maintained constant in an open loop configuration of the assembly. Alternatively, the alignment current may be adjusted in a closed loop configuration of the assembly, by periodical monitoring of the X-ray beam emitted from the optics by the assembly processor, so as to maintain an optimal relative spatial alignment between the X-ray source and the optics.

The combination of coarse mechanical alignment (and a locking mechanism) and fine alignment using the Helmholtz coils, provides the X-ray assembly with tight control of the characteristics of the emitted X-ray beam, and an accurate and fast response to potential drifts in the assembly, in order to maintain a high quality of the emitted X-ray beam.

System Description

FIG. 1 is a block diagram that schematically illustrates an X-ray source assembly 20, in accordance with an embodiment of the present invention.

Assembly 20 comprises a micro-focus X-ray tube 30, such as product AS00613, Mo 5011N, TVA 277-TF5025, 50KV, 50 Watts, 2.5MA TGT, 5ML, known as part number (P/N) 90132, manufactured by Oxford X-ray Technology (Scotts Valley, Calif.) or an AS00855-02, X-Ray Tube MCBM 50G-50 Mo 100 um (cable Length=300 cm), known as P/N: MCBM 50G-50 Mo 100 um, 300 cm manufactured by rtw RÖNTGEN-TECHNIK DR. WARRIKHOFF GmbH & Co. (Berlin, Germany). Tube 30 comprises a cathode 32 which generates electrons accelerated towards a metal anode 34, in the form of a high energy electron beam 36, by a high potential difference of several tens of kV. Anode 34 may be formed from any suitable metal, such as copper, molybdenum, or tungsten.

In tube 30 cathode 32 and anode 34 are enclosed in an electrically insulating envelope 40 which is in the form of a tube, and which is typically made of glass or ceramic. The envelope 40 seals tube 30 from the environment, in high vacuum, and the high energy electrons (from the cathode) of beam 36 interact with metal atoms of anode 34, and generate an X-ray beam. Anode 34 is typically cooled by forced air or circulating water to compensate for the heat generated by the interaction with beam 36.

Tube 30 is surrounded by one or more pairs of Helmholtz coils 42, which are made of insulated solid wires and create a magnetic field, so as to steer electron beam 36 produced in tube 30 onto a selected region on the surface of anode 34. Each pair of coils comprises two substantially similar circular coils of wire placed parallel to each other with a common axis. Each coil carries a substantially equal electrical current flowing in the same direction to create a region of uniform magnetic field across the respective axis. The electrical current is adjustable and proportional to the induced magnetic field.

In some embodiments, two pairs of coils are placed with respective common axes perpendicular to each other, to steer beam 36 in two orthogonal directions. In another embodiment, anode 34 is tilted at an angle with respect to the electron beam to allow improved direction of the X-ray beam. In other embodiments, a given pair of coils comprises a ferromagnetic core to enhance the magnetic field induced by the coils, and thus, the steering effect of the electron beam.

Housing 48 comprises a magnetic shield, which is a passive component, made of mu metal or some other high magnetic permeability material. The magnetic shield protects beam 36 from external stray magnetic fields. Housing 48 comprises additional features such as: a radiation safety and a shutter mechanism, an X-ray tube cooling mechanism (e.g., air or water).

Assembly 20 further comprises X-ray optics 24, which collect the emitted X-ray beam from tube 30, via an X-ray window 38. Optics 24 adjust the characteristics of the X-ray beam to desired specifications and direct the X-ray beam to a detector 26. Such optics may include, but are not limited to: a polycapillary lens or doubly curved crystal (DCC) optics, manufactured by X-ray Optical Systems Inc. (Albany, N.Y.), and multilayer mirror optics, such as FOX series manufactured by Xenocs SA (Grenoble, France) or ASTIX series manufactured by AXO DRESDEN GmbH (Dresden, Germany).

Detector 26 may use a fluorescent screen and a camera, or Silicon-based PIN-photodiode detectors made by Detection Technology, Finland or diamond-based RIGI series detectors made by Dectris Ltd., Switzerland for direct detection. Alternatively, the X-ray beam can be monitored indirectly by detection of scattered X-rays from a suitable target, such as a metal target.

Detector 26 is configured to detect a signal which is formed by the X-ray beam emitted from optics 24. Subsequently, a processor 28 analyzes the detected signal, to characterize optical properties of the X-ray beam, such as spot size, beam intensity, or intensity distribution across the beam spot as a function of energy and wavelength.

In the context of the present patent application and in the claims, detector 26 and processor 28 are referred to collectively as control circuitry, which analyzes the emitted x-ray beam and controls the currents in coils 42 accordingly. In alternative embodiments, the control circuitry may have any other suitable configuration.

Tube 30 and/or optics 24 may be mounted on a mechanical assembly which performs coarse alignment with respect to each other, either manually, for example with a micrometer or automatically with a computer controlled actuator (e.g. a motorized axis). In an embodiment, assembly 20 may comprise a mechanical locking mechanism (e.g., by a set of screws) for the tube and the optics, once coarse alignment is achieved.

The alignment between tube 30 and optics 24 affects the optical characteristics of the detected X-ray beam. In order to provide an X-ray beam with optimal characteristics, fine alignment between tube 30 and optics should be accurate and precise (e.g., repeatable). Mechanical fine alignment can be cumbersome and may result errors and drifts over time and due to temperature and other changes.

In an embodiment, a mechanical assembly is used only for coarse alignment. The assembly is then locked so as to prevent a relative motion between tube 30 and optics 24. The fine alignment is then performed by processor 28, which is configured to receive a detected signal 46 from detector 26, to calculate the required adjustment of the currents in coils 42 and to implement direct current (DC) adjustments in the pairs of Helmholtz coils 42. As a result, coils 42 steer the electron beam to a desired location on the surface of anode 34, and hence, achieve the required level of fine alignment between tube 30 and optics 24.

In some embodiments, fine alignment optimization between tube 30 and optics 24 (by suitable currents in coils 42) can be achieved in an open loop configuration. Once the fine alignment is completed, processor 28 sets a constant current to each pair of Helmholtz coils 42 without further current adjustment in coils 42.

In another embodiment, detector 26 and processor 28 perform closed-loop (e.g., periodical) monitoring and analysis of the emitted X-ray beam and then adjust the DC current supply to each pair of coils accordingly. Such closed loop control of the fine alignment can be used to compensate for changes in the system due to thermal expansion, aging of the tube and/or degradation of the cathode or anode, causing small but very significant misalignment between tube 30 and optics 24.

Typically, processor 28 comprises a general-purpose computer, which is programmed in software to carry out the functions described herein. The software may be downloaded to the computer in electronic form, over a network, for example, or it may, alternatively or additionally, be provided and/or stored on non-transitory tangible media, such as magnetic, optical, or electronic memory.

Figure 2:
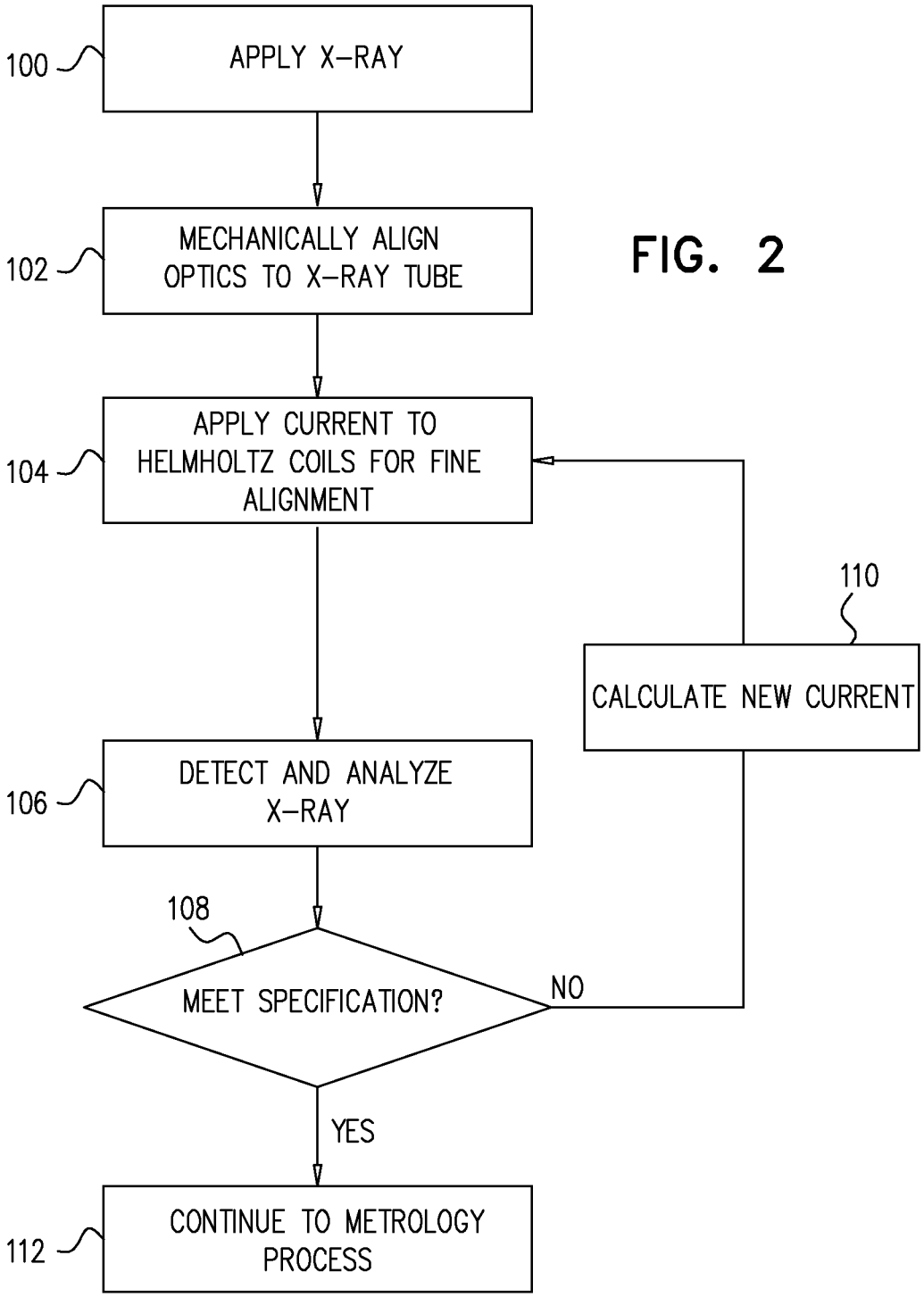
FIG. 2 is a flow chart that schematically illustrates a method for operating an X-ray source, in accordance with an embodiment of the present invention.

FIG. 2 is a flow chart that schematically illustrates a method for operating X-ray source assembly 20 in a closed loop configuration, in accordance with an embodiment of the present invention. The method of FIG. 2 can be used, for example, during installation or setup of the X-ray source assembly, or during normal operation.

The method begins at an X-ray operation step 100, wherein tube 30 emits an X-ray beam into optics 24, which adapts optical characteristics of the X-ray beam to required specification, and then emits the X-ray beam to detector 26. At a mechanical alignment step 102 tube 30 is mechanically aligned with optics 24. The mechanical alignment is performed using the mechanical assembly referred to above, and provides coarse adjustment of the assembly. The coarse adjustment is monitored using the signal from detector 26.

At a fine alignment step 104, processor 28 applies DC currents to one or more pairs of coils 42 in order to steer electron beam 36 on the surface of anode 34, and thus, to provide the fine alignment between X-ray tube 30 and optics 24. As for step 102, the fine alignment may be monitored using the detector signal.

Once tube 30 and optics 24 have been coarsely and finely aligned, the fine alignment may be set to an open loop configuration, as described above. In the open loop configuration the current to the Helmholtz coils is substantially unchanged. Alternatively, the fine alignment may be set to a closed loop configuration, as is also described above. In the closed loop configuration, processor 28 monitors the signal from detector 26, and adjusts the DC current in the Helmholtz coils to correct changes in the signal.

At a detection and analysis step 106, a detected signal 46 of the emitted X-ray beam is sent from detector to processor 28, which analyzes the optical characteristics of the X-ray beam detected in detector 26, and compares it with respect to a target optical specification of the X-ray beam. The target optical specification of the X-ray beam may specify, for example, characteristics such as the beam intensity, spot size, intensity distribution across the spot, and/or various other suitable characteristics.

At a decision step 108, processor 28 uses the comparison between the detected beam and the target specification of the beam. If the detected beam meets the specification, the method continues the metrology process at a metrology step 112. If the detected beam does not meet the specification, then, at a calculation step 110, processor 28 calculates the required adjustment of DC current into the pairs of coils 42 in order to obtain the required alignment between tube 30 and optics 24, and the method loops back to fine alignment step 102.

The flow in FIG. 2 represents a closed loop control, the method may be adapted, mutatis mutandis, for other embodiments of the present invention wherein open loop is used. In such embodiments, once tube 30 and optics 24 have been coarsely and finely aligned, the fine alignment may be set to an open loop configuration, as described above. In the open loop configuration the emitted X-ray beam from optics 24 is not monitored by detector 26, and current to the Helmholtz coils is substantially unchanged.

The embodiments described above refer mainly to compensation for mechanical misalignment between x-ray tube 30 and optics 24. Additionally, the beam control schemes described herein can also be used for optimizing the beam characteristics, e.g., spot size and distribution.

Although the embodiments described herein typically address measurement applications for semiconductor processing techniques, the methods and systems described herein can also be used for the analysis of materials and structures in various material science applications.

It will thus be appreciated that the embodiments described above are cited by way of example, and that the present invention is not limited to what has been particularly shown and described hereinabove. Rather, the scope of the present invention includes both combinations and sub-combinations of the various features described hereinabove, as well as variations and modifications thereof which would occur to persons skilled in the art upon reading the foregoing description and which are not disclosed in the prior art. Documents incorporated by reference in the present patent application are to be considered an integral part of the application except that to the extent any terms are defined in these incorporated documents in a manner that conflicts with the definitions made explicitly or implicitly in the present specification, only the definitions in the present specification should be considered.

The invention claimed is:

1. Apparatus, comprising:

an X-ray tube, which comprises an X-ray window and is configured to direct an electron beam onto an anode so as to emit an X-ray beam through the X-ray window;

X-ray optics, which are mounted externally to the X-ray tube with a mechanical misalignment relative to the X-ray tube, and which are configured to receive the X-ray beam emitted from the X-ray tube through the X-ray window, and to direct the X-ray beam onto a target;

one or more coils, which are configured to steer the electron beam in the X-ray tube using electrical currents flowing through the coils; and control circuitry, which is configured to:

determine, based on the X-ray beam output by the X-ray optics, respective values of the electrical currents that, when flowing in the coils, steer the electron beam to a region of the anode that causes the X-ray beam to compensate for the mechanical misalignment between the X-ray tube and the X-ray optics; and set the electrical currents to the determined values.

2. The apparatus according to claim 1, wherein the control circuitry is configured to set the electrical currents to be constant.

3. The apparatus according to claim 1, wherein the control circuitry is configured to set the electrical currents adaptively based on the X-ray beam.

4. The apparatus according to claim 1, wherein the target comprises a detector comprised in the control circuitry, and wherein the control circuitry further comprises a processor configured to analyze an output of the detector and to set the electrical currents depending on the output.

5. The apparatus according to claim 1, wherein the control circuitry is configured to estimate a deviation of an actual characteristic of the emitted X-ray beam from a specified characteristic, and to set the electrical currents depending on the deviation.

6. The apparatus according to claim 5, wherein the actual and specified characteristics comprise at least one type of characteristic selected from a group of types consisting of a beam intensity, a beam spot size, and an intensity distribution across a beam spot.

7. The apparatus according to claim 1, wherein, in addition to compensating for the misalignment, the control circuitry is configured to optimize a characteristic of the X-ray beam by setting the electrical currents.

8. The apparatus according to claim 1, wherein the X-ray tube comprises an integrated magnetic shield, which is configured to protect the electron beam from magnetic fields external to the X-ray tube.

9. A method, comprising:

in an X-ray tube, which comprises an X-ray window, directing an electron beam onto an anode so as to emit an X-ray beam through the X-ray window;

receiving the X-ray beam emitted from the X-ray tube through the X-ray window, and directing the X-ray beam by X-ray optics, which are mounted externally to the X-ray tube with a mechanical misalignment relative to the X-ray tube, onto a target;

steering the electron beam in the X-ray tube using electrical currents flowing through coils surrounding the X-ray tube; and determining, based on the X-ray beam output from the X-ray optics, respective values of the electrical currents that, when flowing in the coils, steer the electron beam to a region of the anode that causes the X-ray beam to compensate for the mechanical misalignment between the X-ray tube and the X-ray optics, and setting the electrical currents to the determined values.

10. The method according to claim 9, wherein setting the electrical currents comprises setting the electrical currents to be constant.

11. The method according to claim 9, wherein setting the electrical currents comprises setting the electrical currents adaptively based on the X-ray beam.

12. The method according to claim 9, wherein compensating for the misalignment comprises detecting the X-ray beam output by the X-ray optics using a detector, analyzing an output of the detector, and setting the electrical currents depending on the output.

13. The method according to claim 9, wherein determining the respective values comprises estimating a deviation of an actual characteristic of the emitted X-ray beam from a specified characteristic, and setting the electrical currents depending on the deviation.

14. The method according to claim 13, wherein the actual and specified characteristics comprise at least one type of characteristic selected from a group of types consisting of a beam intensity, a beam spot size, and an intensity distribution across a beam spot.

15. The method according to claim 9, and comprising, in addition to compensating for the misalignment, optimizing a characteristic of the X-ray beam by setting the electrical currents.

16. The method according to claim 9, and comprising protecting the electron beam from magnetic fields external to the X-ray tube by applying an integrated magnetic shield.

* * * * *